US006472809B2

(12) United States Patent
Motomiya et al.

(10) Patent No.: US 6,472,809 B2
(45) Date of Patent: Oct. 29, 2002

(54) DEFLECTION YOKE WITH INFLEXIBLE HOLDING PART

(75) Inventors: Yoji Motomiya, Oyama (JP); Keiji Morimoto, Oyama (JP)

(73) Assignee: Victor Company of Japan, Ltd., Kanagawa-ken (JP)

( * ) Notice: Subject to any disclaimer, the term of this patent is extended or adjusted under 35 U.S.C. 154(b) by 104 days.

(21) Appl. No.: 09/784,004

(22) Filed: Feb. 16, 2001

(65) Prior Publication Data

US 2001/0015612 A1 Aug. 23, 2001

(30) Foreign Application Priority Data

Feb. 17, 2000 (JP) ..... 2000-039225

(51) Int. Cl.[7] ..... H01J 29/70

(52) U.S. Cl. ..... 313/440; 335/210; 335/212

(58) Field of Search ..... 313/440; 335/210, 335/212

*Primary Examiner*—Vip Patel

(74) *Attorney, Agent, or Firm*—Connolly Bove Lodge & Hutz LLP

(57) ABSTRACT

A deflection yoke for a cathode ray tube comprises a funnel shaped separator means 1*a*, 1*b* having a cylindrical neck portion 3 where a magnetic ring is attached. The magnetic ring is engaged with upward holding portions 33*a*, 33*b* and with downward holding portions 32*a*, 32*b*, which hold such magnetic ring. Root portions 33*a*3 and 33*b*3 of the downward holding portions 32*a* and 32*b* are substantially inflexible, where the inner circumference of the magnetic ring substantially contacts the root portions 33*a*3 and 33*b*3, and the root portions 33*a*3 and 33*b*3 restrict the position of magnetic ring from being disengaged from the protrusions 33*a*1 and 33*b*1 when the downward holding portions 33*a* and 33*b* are forced to disengage the magnetic ring.

4 Claims, 12 Drawing Sheets

3

63a

DEFLECTION YOKE WITH INFLEXIBLE HOLDING PART

BACKGROUND OF THE INVENTION

1. Field of the Invention

The present invention relates to a deflection yoke, which is used with an in-line type cathode ray tube (CRT), and particularly relates to a deflection yoke for adjusting a characteristic of a magnetic field, such as convergence or purity, by rotating a multipolar magnetic ring mounted on a cylindrical neck portion of such deflection yoke.

2. Description of the Related Art

Generally, a deflection yoke, which is used with an in-line type CRT (cathode ray tube), has a multipolar, for example, dipole or quadrupole magnetic ring. The multipolar magnetic ring is used for adjustment of a magnetic field characteristic such as the convergence or the purity of CRT by tuning a position of such multipolar magnetic ring.

FIG. 11 is a perspective view for explaining an example of a deflection yoke for a CRT. In FIG. 11, the deflection yoke for a CRT comprises a pair of separators 1*a* and 1*b* made by an insulating material on the narrower diameter portion of the deflection yoke, a pair of horizontal deflection coils (not shown) in inside of the deflection yoke, and a pair of vertical deflection coils 7 on the outside and the wider diameter portion of the deflection yoke, and a pair of cores 2 on the outer side of the vertical deflection coil 7, a flange 1*f* is formed in a narrower diameter side of the first separator 1*a* and the second separator 1*b*, and a cylindrical neck portion 103 is formed in the flange 1*f*.

FIG. 12 is a partial perspective view for explaining the example of the deflection yoke shown in FIG. 11 for a CRT. In FIG. 12, the cylindrical neck portion 103 having tongues 3*a* through 3*f*, is formed on a flange 1*f* with the first and second separators 1*a*and 1*b*.

The cylindrical neck portion 103 is inwardly flexible as it has slits 4*a* through 4*f*. A clamp band 5 for fixing the deflection yoke to a neck of the CRT is provided on the neck portion 103. A screw 6 is screwed to the clamp band 5, and fastens the deflection yoke to the neck of the CRT by tightening the clamp band 5 about the neck portion 103.

Each magnetic ring 10 and 11 has multipolar magnet and is provided between the clamp band 5 and the flange 1*f* of the first and second separators 1*a* and 1*b*. FIG. 12 shows the clamp band 5 and the magnetic rings 10 and 11 being removed from the neck portion 103. Generally, the magnetic rings 10 and 11 comprise of material dispersed with magnetic powder such as Barium ferrite or Alnico alloy substance evenly on a nylon plastic. The inner diameter of the magnetic rings 10 and 11 is nearly equal to the outer diameter of the neck portion 103.

More precisely, protrusions 12*a* and 12*b* are flexible in the direction of the Z axis or the longitudinal direction of the neck of the CRT, and are provided at the bottom of the neck portion 103. A hook 13 having a claw 13*a* of triangular shape at their distal ends are formed on the tongues 3*c* and 3*f* of the neck portion 103. The magnetic rings 10 and 11 are inserted from the rear side of the deflection yoke, about the neck portion 103 having a cylindrical shape, between the protrusions 12*a* and 12*b*, and the claw 13*a*.

A prominence 14 is formed on the upper area of the tongues 3*c* and 3*f* for engaging with holes 5*a* and 5*b* of the clamp band 5 respectively. The prominence 14 is sloped away from the neck portion 103 and toward the bottom thereof. As. the hook 13, is flexible, the magnetic rings 10 and 11 are easily set to a predetermined position of the neck portion 103. The distance between the protrusions 12*a* and 12*b*, and the claw 13*a* is shorter than the thickness of the magnetic rings 10 and 11 put together, so that a bounce force of the protrusions 12*a* and 12*b* is applied on the magnetic rings 10 and 11 when such rings are inserted between the protrusions 10 and 11, and the claw 13*a*.

A deflection yoke is attached to a CRT to control magnetic filed characteristic such as convergence, and such control is performed by rotating the position of magnetic rings 10 and 11. An adequate (rotational) torque is added for tuning position of the magnetic rings 10 and 11 by the protrusions 12*a* and 12*b*, and the claw 13*a*, so that the magnetic rings 10 and 11 may not loosely rotate after the tuning and until a glue fixes the appropriate position of the magnetic rings 10 and 11. The rotating torque is obtained by a frictional force occurred by a bounce force of the protrusions 12*a* and 12*b* in upward direction of Z axis in FIG. 12.

According to the above prior art mentioned, a width of a slit between the tongues 3*a* through 3*f* and the pair of magnetic rings 10 and 11 becomes bigger as the neck portion 103 becomes narrower by tighten a bolt 6 to make inner circle of the clamp band 5 smaller. A neck portion of the CRT has a variation of the thickness, and the width of a slit between the tongues 3*a* through 3*f* and the pair of magnetic rings 10 and 11 becomes more bigger when the deflection yoke is attached to the neck portion, which has thinner circle. As a result, a pair of tongues 13 holds the pair of the magnetic rings 10 and 11 from the inner circumference of the magnetic ring in the radial direction.

However, the tongues 13 is flexible inwardly to the neck portion 103 as a inward force pushes one of the tongues 13 at the tuning of the magnetic rings 10 and 11 that the magnetic rings 10 and 11 are released from the tongue 13. Then the magnetic rings 10 and 11 are disengaged from the attached position between the protrusions 12*a* and 12*b*, and the claw 13*a*.

SUMMARY OF THE INVENTION

Accordingly, in consideration of the above-mentioned problem of the related art, an object of the present invention is to provide a deflection yoke of which a magnetic ring is attached to the neck portion, to control convergence by tuning such magnetic ring, and which can prevent a magnetic ring from being disengaged from a neck portion without losing smooth attachment to the neck portion.

In order to achieve the above object, the present invention provides, according to an aspect thereof, a deflection yoke for a cathode ray tube comprising: separator means in a funnel shape having a narrower diameter portion and a wider diameter portion, wherein a neck portion in a cylindrical shape is formed on said narrower diameter portion; magnetic ring means rotatably mounted on said neck portion; holding means having at least a pair of holding portions for holding said magnetic ring means from said narrower diameter portion side and said wider diameter portion side respectively, wherein said holding portion of narrower diameter portion side has an inwardly flexible portion; and inflexible holding means having a substantially inflexible portion for restricting position of said magnetic ring means where said inflexible holding means substantially contacts the inner circumference surface of said magnetic ring means after said magnetic ring means is attached to thereto.

Other objects and further features of the present invention provides the deflection yoke as mentioned above, wherein said inflexible holding means is combined with said flexible holding means, and wherein said flexible holding means and said inflexible holding means are formed in distant position on circular direction of said neck portion.

Other object and further features of the present invention provides the deflection yoke as mentioned above, wherein said inflexible holding means is formed separately with said flexible holding means, and wherein said flexible holding means and said inflexible holding means are formed in distant position on circular direction of said neck portion.

Other object and further features of the present invention provides the deflection yoke as mentioned above, wherein said inflexible holding means is formed separately with said flexible holding means, and wherein said flexible holding means and said inflexible holding means are formed in identical position of circular direction of said neck portion.

A deflection yoke incorporating the principles of the present invention will be. described in detail with reference to the accompanying drawings, in which the same reference numerals and symbols are used to denote like or equivalent elements used in the aforementioned prior art deflection yoke, and the detailed explanation of such elements are omitted for simplicity.

DETAILED DESCRIPTION OF THE PREFERRED EMBODIMENTS

First Embodiment

Figure 1:
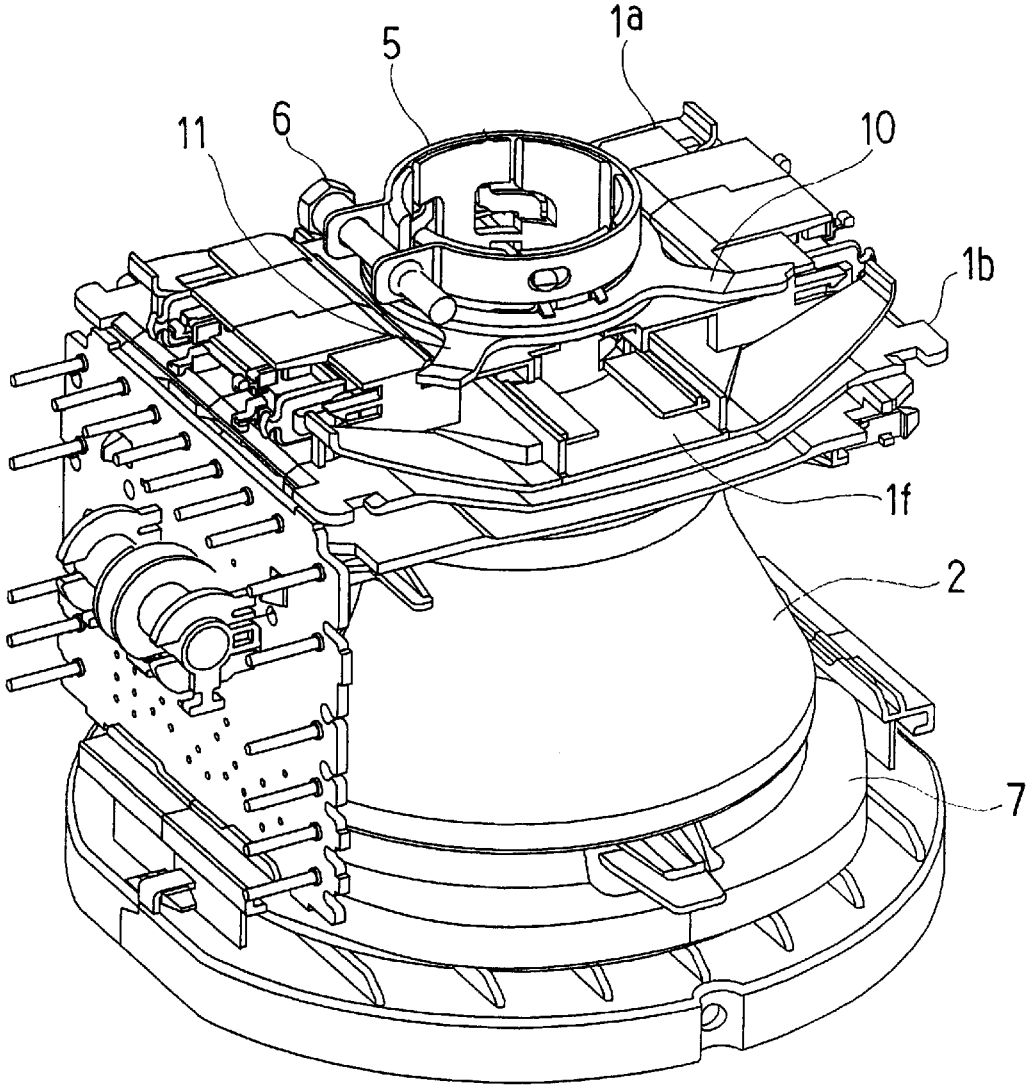
FIG. 1 is a perspective view of a deflection yoke common to all embodiments according to the present invention.

FIG. 1 is a perspective view of a deflection yoke according to the present invention. In FIG. 1, a deflection yoke for a CRT comprises a pair of separator 1*a* and 1*b* made by an insulating material, a pair of horizontal deflection coils (not shown) in an inner side of the deflection yoke, a pair of vertical deflection coils 7 in outer side thereof, a pair of cores 2 in outer side of the vertical deflection coil 7, a flange 1*f* on a minor diameter side of the separators 1*a* and 1*b* with a cylindrical neck portion 3, forming on the flange 1*f*, a clamp band 5 to fix a deflection yoke to a neck of the CRT, a screw 6 to fasten deflection yoke to the neck of CRT by tightening the clamp band 5 about the neck portion 3, and a pair of magnetic rings 10 and 11 to control magnetic characteristic of a deflection yoke.

The neck portion 3 is formed on the flange 1*f* with a pair of separators 1*a* and 1*b*. The neck portion 3 is flexible inwardly by a plural of slits 4*a* through 4*f* formed on the neck portion 3. The clamp band 5 is attached to the neck portion 3 to stabilize the deflection yoke on a neck portion of a CRT. The clamp band 5 is screwed with a bolt 6 to tighten an inner circumference of the clamp band 5 to stabilize the deflection yoke on the neck portion of the CRT.

Figure 2:
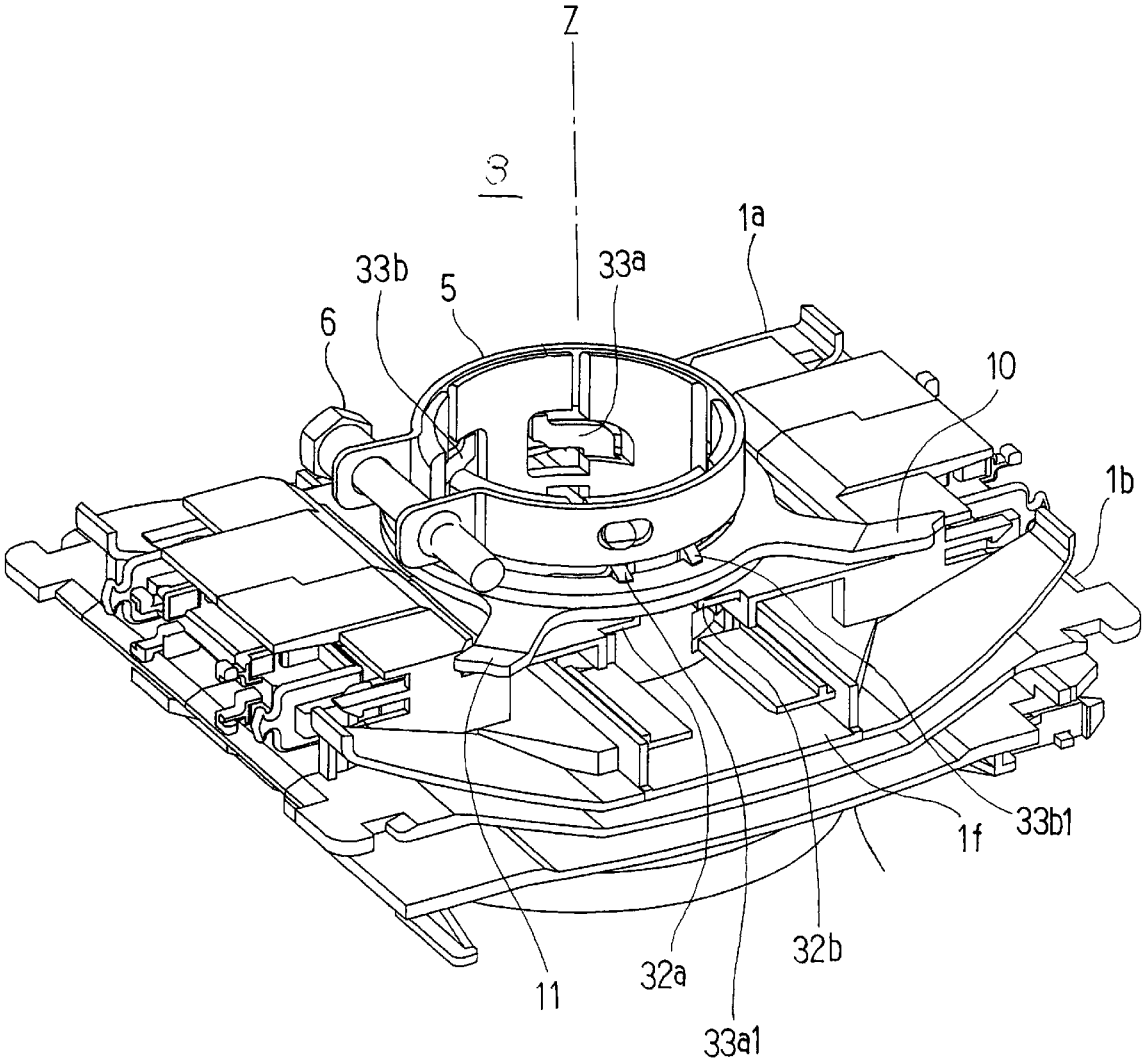
FIG. 2 is a partial perspective view of a deflection yoke shown in FIG. 1 according to a first embodiment of the present invention.

FIG. 2 is a partial perspective view of substantial portion of a deflection yoke shown in FIG. 1 according to the present invention, in which a flange 1*f* with a clamp band 5, and a pair of magnetic rings 10 and 11 attached onto a neck portion 3. A pair of multipolar magnetic rings 10 and 11 are attached between the clamp band 5 and the pair of the separators 1*a* and 1*b*, of the flange 1*f* by a head portion 33*a*1 of a holding portion 32*a* and a head portion 33*b*1 of a holding portion 32*b*, and by a head portion not shown but formed on the upper holding portions 33*a* and 33*b*. Generally, the pair of magnetic rings 10 and 11 comprises material dispersed with magnetic powder such as Barium ferrite or Alnico alloy substance evenly on a nylon plastic.

Figure 3:
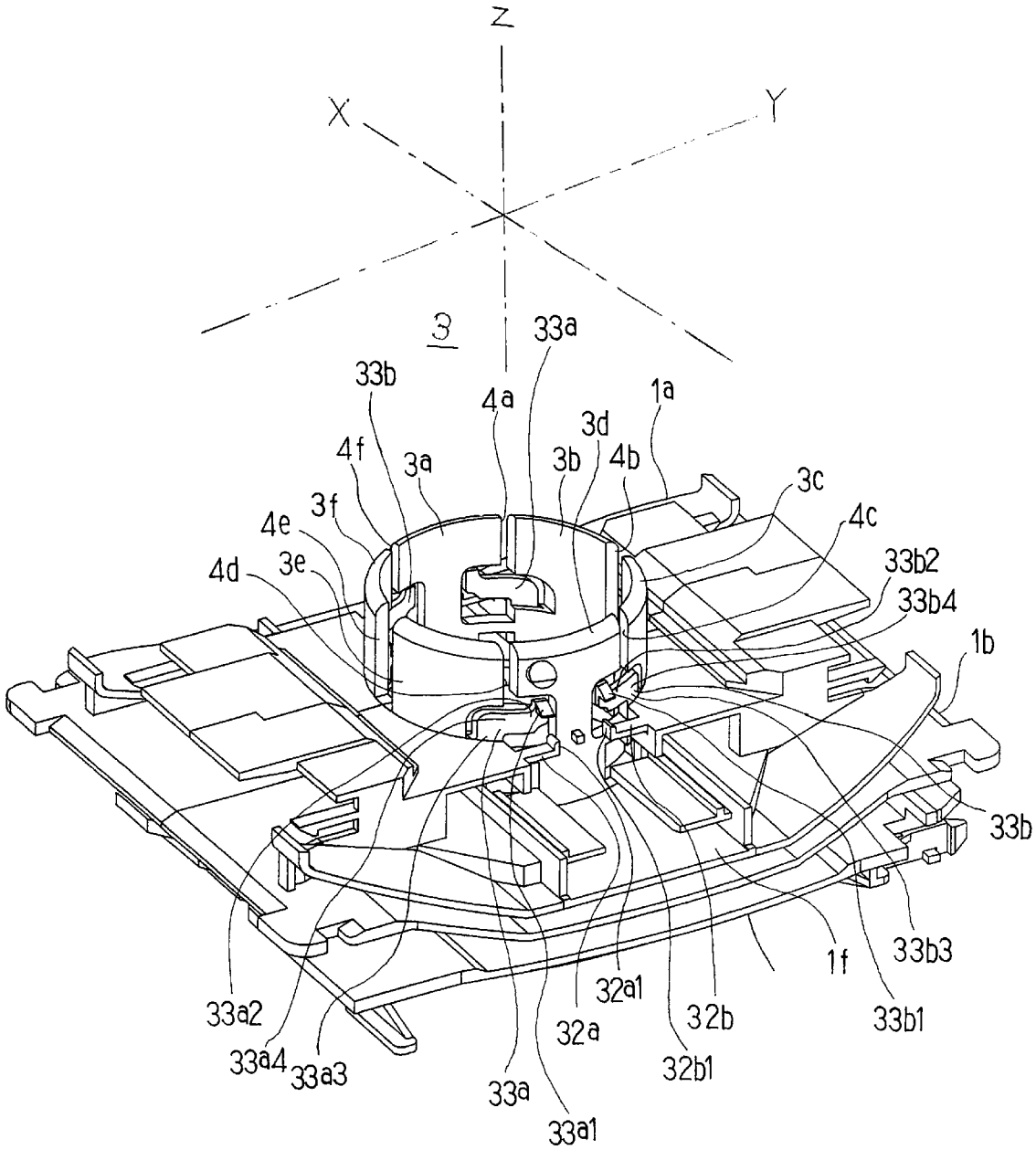
FIG. 3 is a partial perspective view of a deflection yoke according to the first embodiment of the present invention.

FIG. 3 is a partial perspective view of substantial portion of a deflection yoke shown in FIG. 1 according to the present invention, wherein the clamp band 5 and the pair of magnetic rings 10 and 11 removed from the neck portion 3 in comparison with FIG. 2. A holding portion 32*a* and a holding portion 32*b* are formed on the flange 1*f* with brachial shape, and they can flexibly bend to the direction of Z axis or the longitudinal direction of the neck of the CRT. There formed a protuberance 32*a*1 and a protuberance 32*b*1 in the head portion of the holding portions 32*a* and 32*b* respectively. Each holding portion 32*a* and 32*b* is placed on the outer side of the neck portion 3 to hold a tongue 3*d*. There formed a pair of protrusions, which is not visible in FIG. 3, symmetric to the holding portions 32*a* and 32*b* behind the tongue 3*a* to hold the tongue 3*a*.

On the flange 1*f*, there formed an ell shaped upper holding portions 33*a* and 33*b*. There formed a protuberance 33*a*1 and a protuberance 33*b*1 in the head portion of the holding portions 32*a* and 32*b* respectively. Each protuberance 33*a*1 and 33*b*1 is inclined from the narrower to the wider diameter direction as the raised portion extends to the outer direction. The upper holding portions 33*a* and 33*b*, and the tongues 3*a* through 3*f* are placed on the same circumference surface surrounding the tongues 3*a* and 3*b*. Each protuberance 32*a*1 and 32*b*1 of the holding portion 32*a* and 32*b* opposes to each protuberance 33*a*1 and 33*b*1 of the upper holding portion 33*a* and 33*b*. The holding portion 32*a* and the upper holding portion 33*a*, and the holding portion 32*b* and the upper holding portion 33*b* hold the magnetic rings 10 and 11 as shown in FIG. 2.

Figure 4:
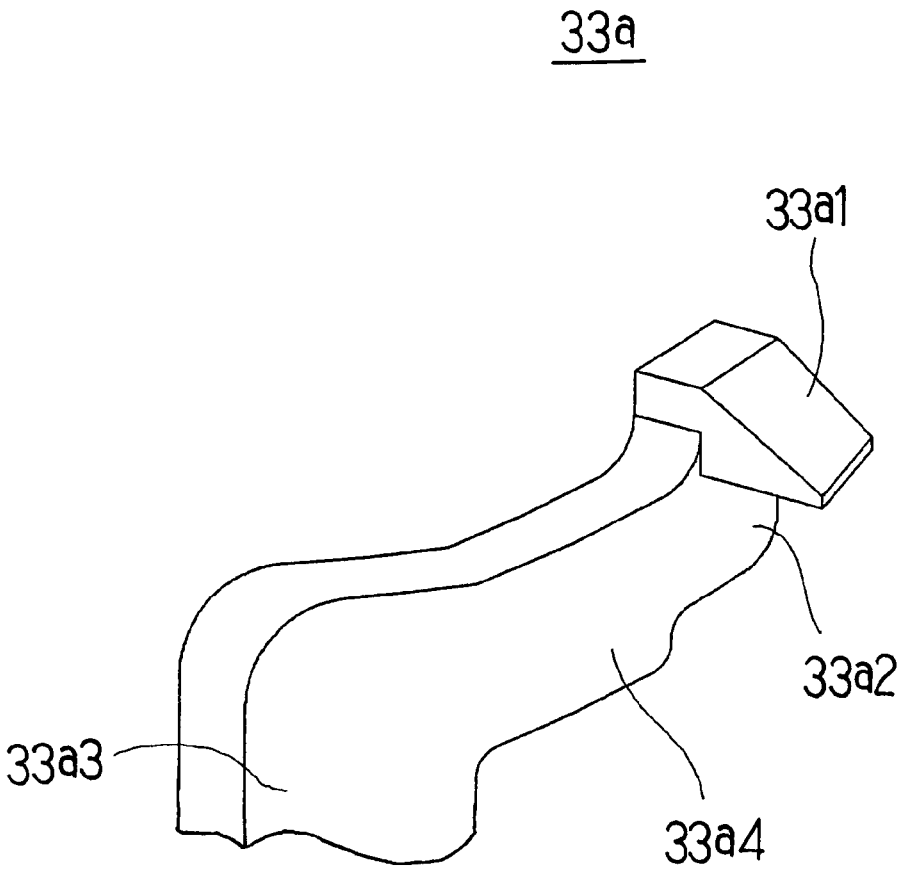
FIG. 4 is an enlarged view of a substantial portion of a deflection yoke shown in FIGS. 2 and 3.

FIG. 4 is an enlarged view of the upper holding portion 33*a* which is a substantial portion of a deflection yoke, according to the present invention. The upper holding portion 33*b* has symmetric shape of the upper holding portion 33*a* and substantially has the same functionality of the upper holding portion 33*a*. Accordingly, FIG. 4 shows only the upper holding portion 33*a* for explanation. The upper holding portion 33*a* comprises a protuberance 33*a*1 in a head portion 33*a*2, and a root portion 33*a*3 to combine with the flange 1*f*, and an intermediate portion 33*a*4 to connect the head portion 33*a*2 with the root portion 33*a*3. The upper holding portion 33*b* also comprises a head portion 33*b*2 with a protuberance 33*b*1, a root portion 33*b*3 to combine with the flange 1*f*, and an intermediate portion 33*b*4 to connect the head portion 33*b*2 with the root portion 33*b*3.

Figure 5:
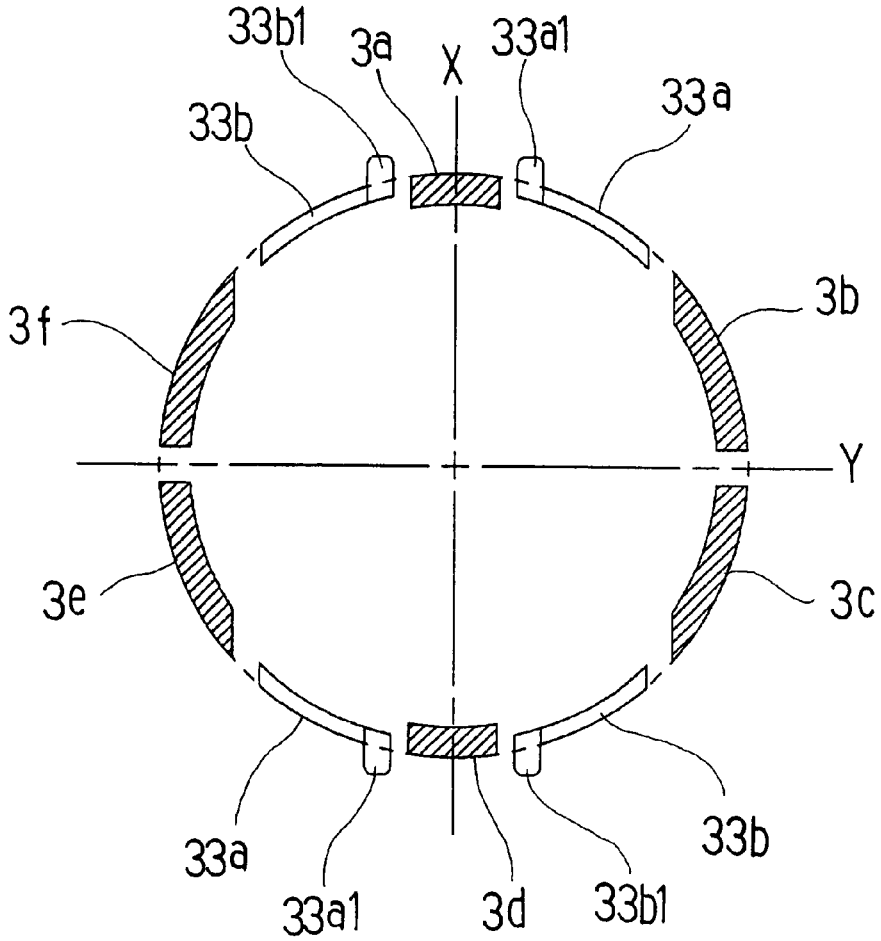
FIG. 5 is a cross-sectional view taken substantially along X and Y axis of FIG. 3 for explaining an operation of a deflection yoke according to the present invention.

FIG. 5 is a cross-sectional view of the neck portion 3 shown in FIG. 3 in orthogonal direction of Z axis for explaining an operation of a deflection yoke according to the present invention. In FIG. 5, X is a horizontal axis for the deflection yoke being attached to the CRT, and Y is a vertical axis for the same. As shown in FIG. 5, the upper holding portions 33*a* and 33*b*, and the tongues 3*a* through 3*f* of the neck portion 3 are formed in the same circle face except for the protuberances 33*a*1 and 33*b*1.

Figure 6:
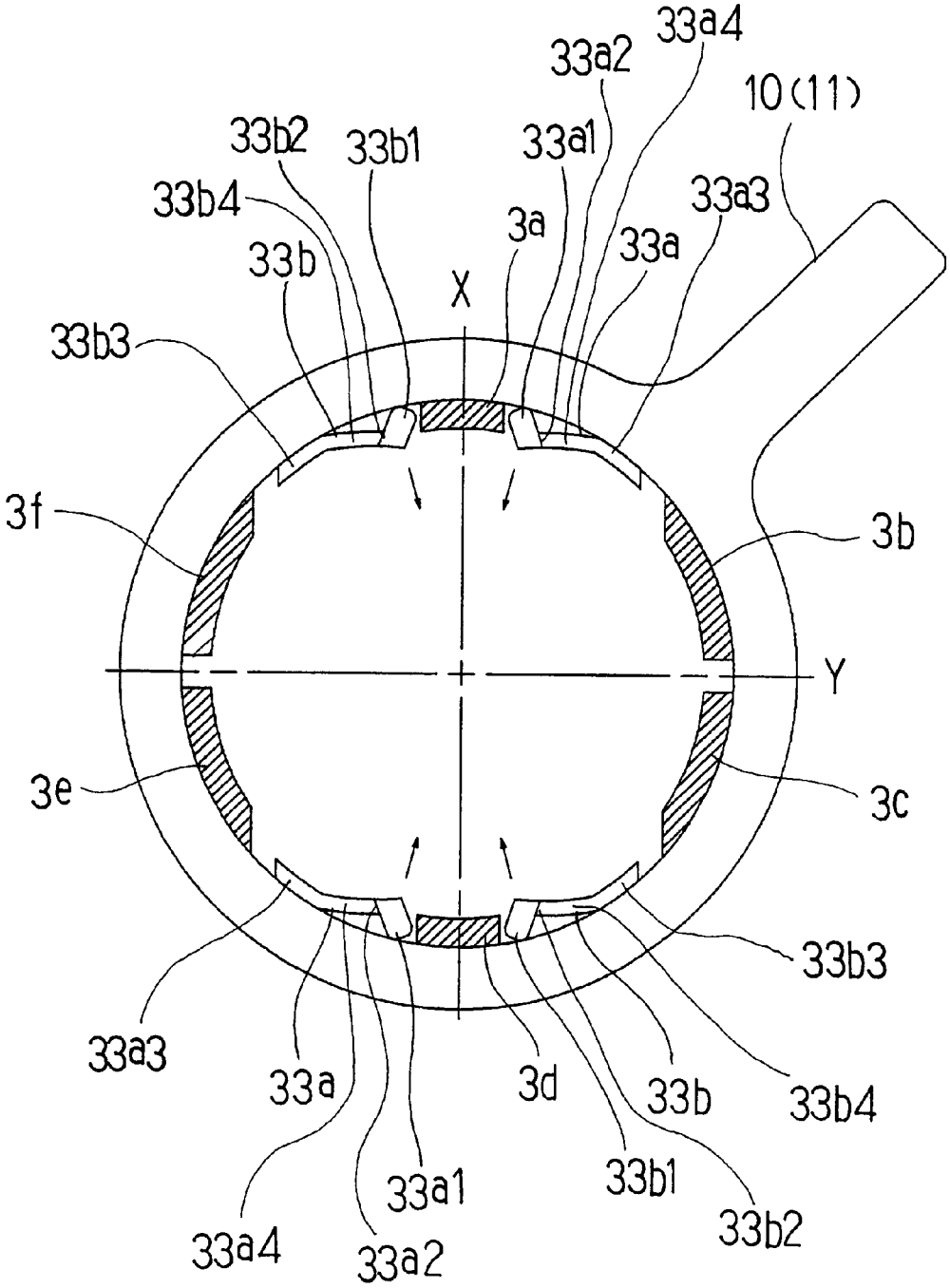
FIG. 6 is a cross-sectional view of a magnetic ring taken substantially along X and Y axis of FIG. 3 for a deflection yoke according to the present invention.

FIG. 6 is a cross-sectional view of a magnetic ring 10 attached to the neck portion 3 of the deflection yoke according to the present invention. The magnetic ring 11 can also be attached to the neck portion 3 of the deflection yoke as shown in FIG. 6. The magnetic ring 10 is inserted from the narrower diameter side of the neck portion 3, and pushes the protuberances 33*a*1 and 33*b*1 to the inner side of the neck portion 3. The protrusions 33*a* and 33*b* are formed on the flange 1*f*, and have flexibility so that the head portions 33*a*2 and 33*b*2 can inwardly flex.

Figure 12:
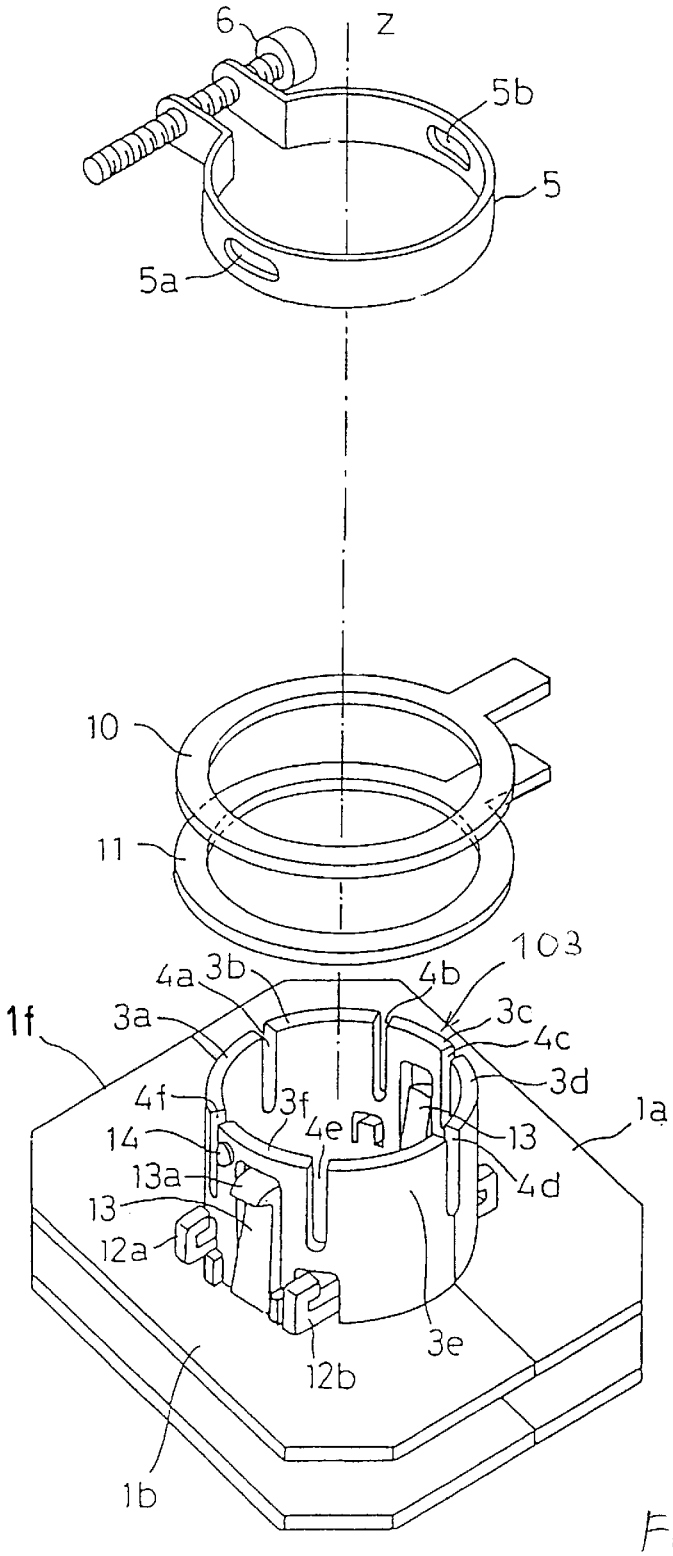
Fig 12 PRIOR ART
FIG. 12 is a partial perspective view for explaining an example of a deflection yoke shown in FIG. 11 for a cathode ray tube according to the prior art.

However, the upper holding portions 33*a* and 33*b* are different from the tongue 13 as shown in FIG. 12 that they have a root portion 33*a*3 and a root portion 33*b*3 in a distant place from the protuberances 33*a*1 and 33*b*1 in circle direction. Accordingly, the root portions 33*a*3 and 33*b*3 are inflexible. The intermediate portion 33*a*4 and 33*b*4 is little more flexible than this and the head portions 33*a*3 and 33*b*2 are inwardly flexible. The magnetic rings 10 and 11 are attached between the holding portions 32*a* and 32*b*, and the protuberances 33*a*1 and 33*b*1 by the head portions 33*a*2 and 33*b*2 inwardly flexed.

The root portions 33*a*3 and 33*b*3 will be inflexible even the thickness of the head portions 33*a*2 and 33*b*2 to the root portion 33*a*3 and 33*b*3 is constant respectively. It is more favorable 1*f* the thickness of each root portions 33*a*3 and 33*b*3 is bigger than the intermediate portions 33*a*4 and 33*b*4 so that the root portions 33*a*3 and 33*b*3 will be even more inflexible.

Figure 7:
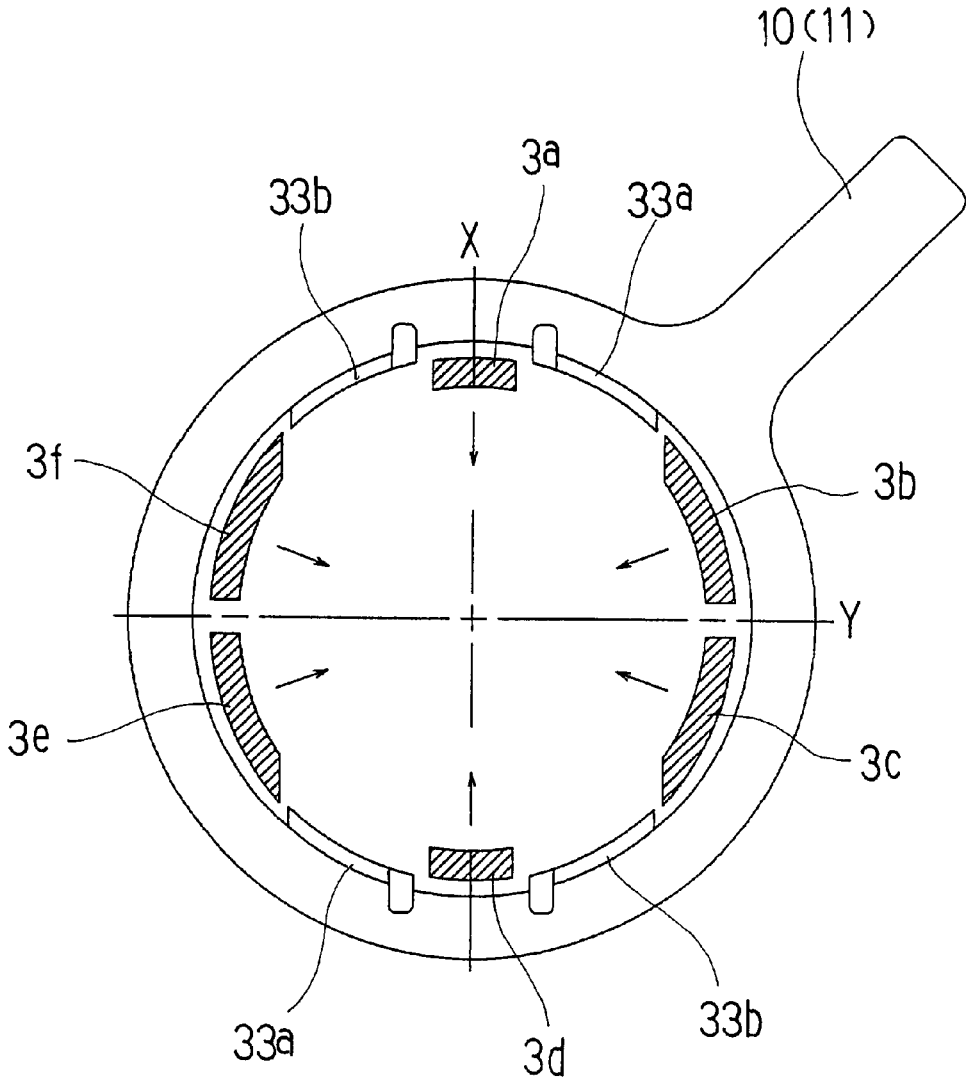
FIG. 7 is for explaining an operation of a magnetic ring for a deflection yoke shown in FIG. 6 according to the present invention.

FIG. 7 is for explaining an operation of a magnetic ring for a deflection yoke shown in FIG. 6 according to the present invention. As a screw 6 is screwed to tighten the clamp band 5 and fasten the neck portion 3, the tongues 3*a* through 3*f* are inwardly flexed (to the direction of the arrows shown in FIG. 7), and the inner circumference of the neck portion becomes smaller than that of the magnetic rings 10 and 11. In this sense, The holding portions 33*a* and 33*b*, and the tongues 3*a* through 3*f* independently hold the magnetic rings 10 and 11.

Even if the magnetic rings 10 and 11, or the upper holding portions 33*a* and 33*b* are pushed inwardly to the radial direction, at the tuning or after the tuning of the magnetic rings 10 and 11, the root portions 33*a*3 and 33*b*3 are inflexible so that the root portions 33*a*3 and 33*b*3 hold the magnetic rings 10 and 11. Accordingly, the protuberances 33*a*1 and 33*b*1 still hold the magnetic rings 10 and 11.

Second Embodiment

Figure 8:
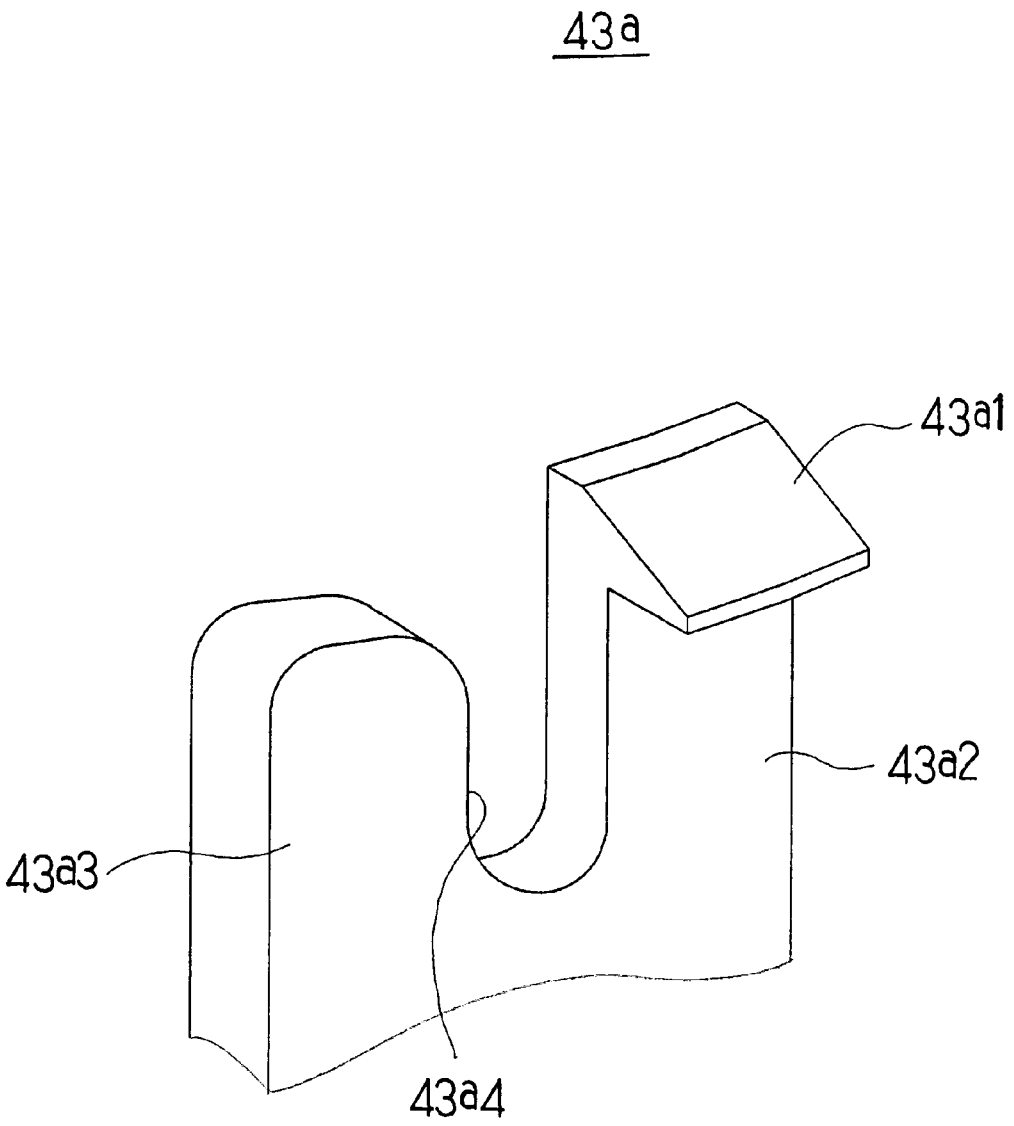
FIG. 8 is an enlarged view of a substantial portion of a second embodiment of a deflection yoke according to the present invention.

FIG. 8 is an enlarged view of a substantial portion of a second embodiment of a deflection yoke according to the present invention. In FIG. 8, an upper holding portion 43*a* can be a substitution for the upper holding portion 33*a*, and the upper holding portion 43*a* comprises a first tongue 43*a*2 having a protuberance 43*a*1 and a second tongue 43*a*3. The first tongue 43*a*2 and the second tongue 43*a*3 are substantially separated from each other by a slit 43*a*4. A substitution for the protrusion 33*b* will be referred to as a upper holding portion 43*b* which is not shown in FIG. 8. The upper holding portion 43*b* has a symmetrical shape of the upper holding portion 43*a* and comprises of a first tongue 43*b*2 having a protuberance 43*b*1, and a second tongue 43*a*3, and a slit 43*b*4.

The first tongues 43*a*2 and 43*b*2 are flexible inwardly, and the second tongues 43*a*3 and 43*b*3 are substantially inflexible. The first tongues 43*a*2 and 43*b*2, and the second tongues 43*a*3 and 43*b*3 can be separated completely. As shown in FIG. 8, the root portion of the first tongues 43*a*2 and 43*b*2, and the second tongues 43*a*3 and 43*b*3 are connected with each other but there provided the slits 43*a*4 and 43*b*4 respectively that the first tongues 43*a*2 and 43*b*2, and the second tongues 43*a*3 and 43*b*3, which are substantially separated, are all equal in this embodiment of the present invention. The upper holding portions 43*a* and 43*b* having inflexible second tongues 43*a*3 and 43*b*3 to restrict the position of inner circumference surface of the magnetic rings 10 and 11 in a distant place of the first tongues 43*a*2 and 43*b*2 having the protuberances 43*a*1 and 43*b*1.

Third Embodiment

Figure 9:
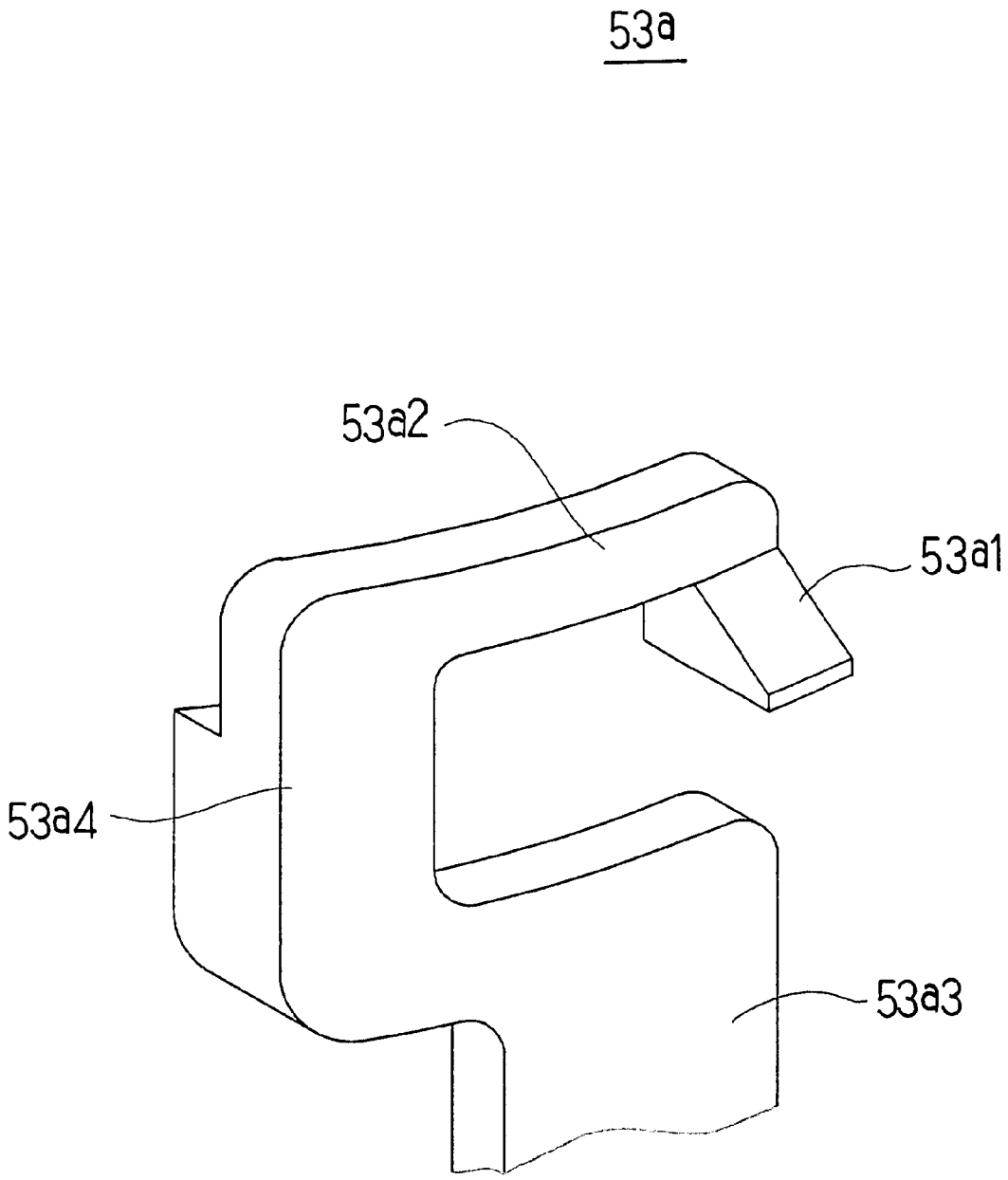
FIG. 9 is an enlarged view of a substantial portion of a third embodiment of a deflection yoke according to the present invention.

FIG. 9 is an enlarged view of a substantial portion of a third embodiment of a deflection yoke according to the present invention. In FIG. 9, a upper holding portion 53*a* is a substitution of the upper holding portion 33*a*. The upper holding portion 53*a* comprises a head portion 53*a*2 having a claw shaped protuberance 53*a*1, a root-portion 53*a*3 combining with the flange 1*f*, an intermediate portion 53*a*4 connecting the head portion 53*a*2 with the root portion 53*a*3. The upper holding portion 53*a* is similar to the ell shaped upper holding portions 33*a* and 33*b* shown in FIG. 4 that the flexible portion and the inflexible portion is combined in one piece. An upper holding portion 53*b* is not shown in FIG. 9 but it has a symmetric shape of the upper holding portion 53*a*. The upper holding portion 53*b* not shown in FIG. 9 has a protuberance 53*b*1, a head portion 53*b*2, a root portion 53*b*3 and an intermediate portion 53*b*4. The intermediate portions 53*a*4 and 53*b*4 in this embodiment are thicker than the other portions of the upper holding portions 53*a* and 53*b*.

As the magnetic rings 10 and 11 are inserted in the neck portion 3 from the narrower diameter side of the deflection yoke, the magnetic rings 10 and 11 climb over the protuberances 53*a*1 and 53*b*1, and the inner circumference surface of the magnetic rings 10 and 11 substantially touch the root portions 53*a*3 and 53*b*3. In this situation, the head portions 53*a*2 and 53*b*2 will be flexible, and the root portions 53*a*3 and 53*b*3, and the intermediate portions 53*a*4 and 53*b*4 will be inflexible. The root portions 53*a*3 and 53*b*3, and the intermediate portions 53*a*4 and 53*b*4 will hold the position of the inner circumference surface of the magnetic rings 10 and 11, and prevent the rings from disengaged from such position.

The flexible portion such as the head portions 53*a*2 and 53*b*2, and the intermediate portions 53*a*4 and 53*b*4, and the inflexible portion such as the root portions 53*a*3 and 53*b*3 shown in FIG. 9 are formed in the same circular direction. The head portions 53*a*2 and 53*b*2 are more flexible inwardly. The flexible portion and the inflexible portion can be formed in the same circular direction.

Fourth Embodiment

Figure 10:
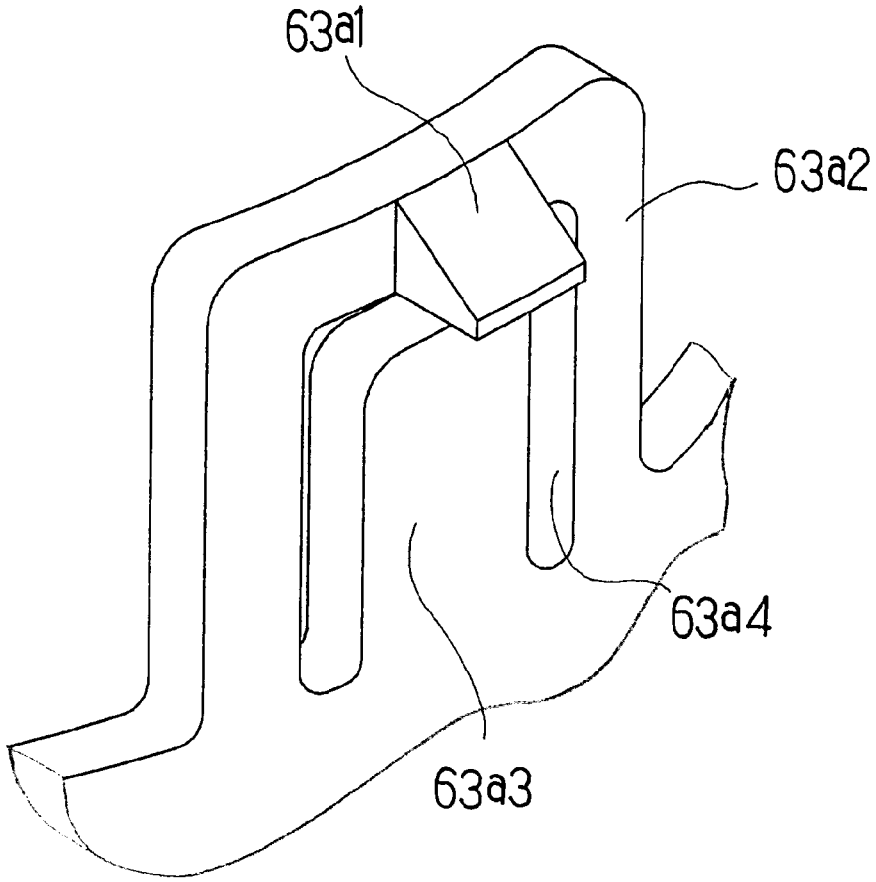
FIG. 10 is an enlarged view of a substantial portion of a fourth embodiment of a deflection yoke according to the present invention.
Figure 11:
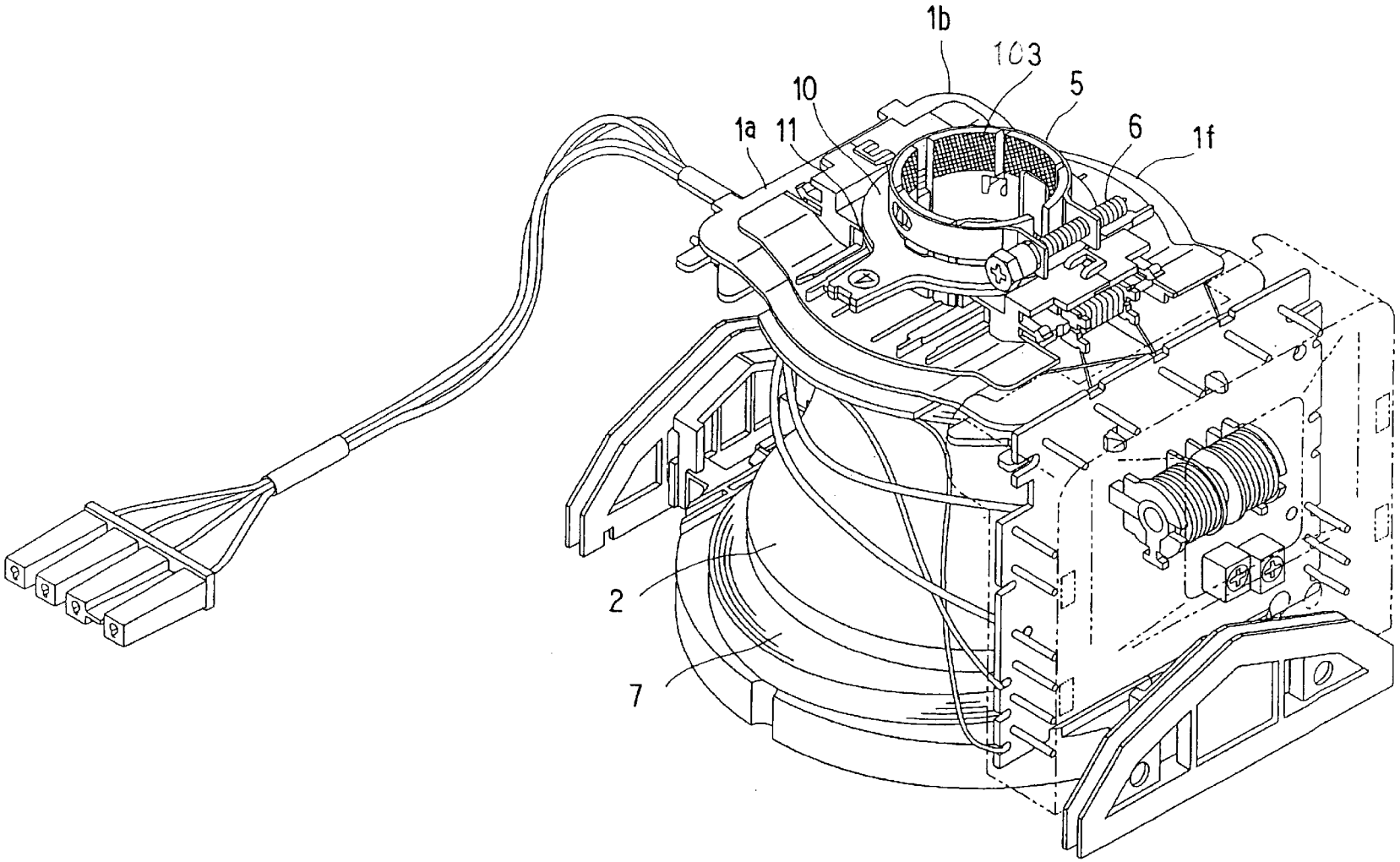
Fig 11 PRIOR ART
FIG. 11 is a perspective view for explaining an example of a deflection yoke for a cathode ray tube according to the prior art.

FIG. 10 is an enlarged view of a substantial portion of a fourth embodiment of a deflection yoke according to the present invention. FIG. 10 shows an upper holding portion 63*a* which is a substitution of the upper holding portion 33*a* shown in FIG. 4, having a first tongue 63*a*2 with a claw shaped protuberance 63*a*1 in the head portion, and having a second tongue 63*a*3 hollowed out of the first tongue 63*a*2. The first tongue 63*a*2 and the second tongue 63*a*3 is substantially separated by an opposite oxbow shaped slit 63*a*4. An upper holding portion 63*b* not shown in FIG. 10 has symmetric shape of the upper holding portion 63*a*, and it has a protuberance 63*b*1, a first and second tongues 63*b*2 and 63*b*3, and an opposite oxbow shaped slit 63*b*4.

The first tongues 63*a*2 and 63*b*2 are flexible inwardly to the neck portion 3, and the second tongues 63*a*3 and 63*b*3 are inflexible. The first tongues 63*a*2 and 63*b*2, and the second tongues 63*a*3 and 63*b*3 can be separated substantially. The first tongue 63*a*2 and the second tongue 63*a*3, and the first tongue 63*b*2, and the second tongue 63*b*3 are connected with each other by the root portion respectively, but each first and second tongue is substantially separated by the slit 63*a*4 and 63*b*4. The holding portions 63*a* and 63*b* having the first tongues 63*a*2 and 63*b*2 with the protuberances 63*a*1 and 63*b*1, and having inflexible portion of the second tongues 63*a*3 and 63*b*3 in the same circular direction hold position of the inner circumference surface of the magnetic rings 10 and 11.

Each embodiment of the present invention as explained above have the protuberances 33*a*1, 33*b*1, 43*a*1, 43*b*1, 53*a*1, 53*b*1, 63*a*1 and 63*b*1 as being formed flexible, which can easily attach the magnetic rings 10 and 11 on to the neck portion 3. After the magnetic rings 10 and 11 are attached to the neck portion 3, the inflexible portion such as the root portion 33*a*3 and 33*b*3, the second tongue 43*a*3 and 43*b*3, the root portion 53*a*3 and 53*b*3, and the second tongue 63*a*3 and 63*b*3 can hold the position of the inner circumference surface of the magnetic rings 10 and 11. Accordingly, the magnetic rings 10 and 11 can not be disengaged from the neck portion 3. Additionally, the inflexible portion in accordance with the above explanation may be in actual contact with the magnetic rings 10 and 11, but they may also be in a position contiguous and not in actual contact with each other.

The position of the upper holding portions 33*a*, 33*b*, 43*a*, 43*b*, 53*a*, 53*b*, 63*a* and 63*b*, i.e. the position of the upward protuberance 33*a*1, 33*b*1, 43*a*1, 43*b*1, 53*a*1, 53*b*1, 63*a*1 and 63*b*1, and the position of the holding portions 32*a* and 32*b*, i.e. downward protrusions are opposed to each other. Accordingly, even 1*f* the magnetic rings 10 and 11 have an awkward or a curved shape, the rotation torque of the magnetic rings 10 and 11 can be constant and stable so that the convergence is effectively adjusted by rotating the magnetic rings 10 and 11. It is preferable to keep an upward holding portion and a downward holding portion opposed to each other to hold a magnetic ring.

While the invention has been described above with reference to specific embodiment, the present invention is not limited to the embodiments explained herein. For example, there provided two pairs of holding portions in one side of the neck portion 3 which holds the magnetic rings 10 and 11, but there also can be one pair of holding portion. Additionally, a magnetic ring attached to the neck portion 3 is not limited to number of two that there also can be single magnetic ring or more than three magnetic rings as well.

According to an aspect of the present invention, there provided a deflection yoke having a substantially inflexible portion which portion substantially touches the inner circle surface of a magnetic ring to restrict the position of such magnetic ring, so that the magnetic ring can be easily attached to a neck portion of a deflection yoke, and that the ring can not unexpectedly disengaged from the neck portion.

What is claimed is:

1. A deflection yoke for a cathode ray tube comprising:

separator means in a funnel shape having a narrower diameter portion and a wider diameter portion, wherein a neck portion in a cylindrical shape is formed on said narrower diameter portion;

magnetic ring means rotatably mounted on said neck portion;

holding means having at least a pair of holding portions for holding said magnetic ring means from said narrower diameter portion side and said wider diameter portion. side respectively, wherein said holding portion of narrower diameter portion side has an inwardly flexible portion; and inflexible holding means having a substantially inflexible portion for restricting position of said magnetic ring means where said inflexible holding means substantially contacts the inner circumference surface of said magnetic ring means after said magnetic ring means is attached to thereto.

2. The deflection yoke as claimed in claim 1, wherein said inflexible holding means is combined with said flexible holding means, and wherein said flexible holding means and said inflexible holding means are formed in distant position on circular direction of said neck portion.

3. The deflection yoke as claimed in claim 1, wherein said inflexible holding means is formed separately with said flexible holding means, and wherein said flexible holding means and said inflexible holding means are formed in distant position on circular direction of said neck portion.

4. The deflection yoke as claimed in claim 1, wherein said inflexible holding means is formed separately with said flexible holding means, and wherein said flexible holding means and said inflexible holding means are formed in identical position of circular direction of said neck portion.

* * * * *